US005716462A

United States Patent [19]

Sakurada et al.

[11] Patent Number: 5,716,462

[45] Date of Patent: Feb. 10, 1998

[54] MAGNETIC MATERIAL AND BONDED MAGNET

[75] Inventors: Shinya Sakurada, Yokohama; Akihiko Tsutai, Kawasaki; Takahiro Hirai, Kamakura; Yoshitaka Yanagita, Yokohama; Masashi Sahashi, Yokohama; Tomohisa Arai, Yokohama; Keisuke Hashimoto, Yokohama, all of Japan

[73] Assignee: Kabushiki Kaisha Toshiba, Kawasaki, Japan

[21] Appl. No.: 671,595

[22] Filed: Jun. 28, 1996

[30] Foreign Application Priority Data

Jun. 30, 1995 [JP] Japan ..... 7-164373
May 29, 1996 [JP] Japan ..... 8-135036

[51] Int. Cl.[6] ..... H01F 1/057

[52] U.S. Cl. ..... 148/302; 252/62.54

[58] Field of Search ..... 148/302; 420/83, 420/121; 252/62.54

[56] References Cited

U.S. PATENT DOCUMENTS

| | | | |
|---|---|---|---|
| 4,983,232 | 1/1991 | Endoh et al. | 148/302 |
| 5,089,065 | 2/1992 | Hamano et al. | 148/302 |
| 5,230,751 | 7/1993 | Endoh et al. | 148/302 |
| 5,250,206 | 10/1993 | Nakayama et al. | 252/62.54 |
| 5,480,495 | 1/1996 | Sakurada et al. | 148/301 |
| 5,482,573 | 1/1996 | Sakurada et al. | 148/301 |

FOREIGN PATENT DOCUMENTS

| | | | |
|---|---|---|---|
| 0549149A1 | 6/1993 | European Pat. Off. | 148/302 |
| 63-301505 | 12/1988 | Japan | 148/302 |
| 4-288801 | 10/1992 | Japan . | |

OTHER PUBLICATIONS

IEEE Transactions on Magnetics, vol. 25, No. 5, pp. 3309–3311, Sep. 1989, J. Strzeszewski, et al., "High Coercivity in $Sm(FeT)_{12}$ Type Magnets".

Appl. Phys. Lett., vol. 67, No. 21, pp. 3197–3199, Nov. 20, 1995, T. Yoneyama, et al., "Magnetic Properties of Rapidly Quenched High Remanence Zr Added Sm–Fe–N Isotropic Powders".

*Primary Examiner*—John Sheehan
*Attorney, Agent, or Firm*—Oblon, Spivak, McClelland, Maier & Neustadt, P.C.

[57] ABSTRACT

There is provided a magnetic material having a $TbCu_7$ phase as a principal phase and excellent in residual magnetic flux density. This magnetic material is formed of a composition represented by a general formula:

$$R1_xR2_yB_zA_uM_{100-x-y-z-u}$$

wherein R1 is at least one element selected from rare earth elements including Y; R2 is at least one element selected from Zr, Hf and Sc; A is at least one element selected from H, N, C and P; M is at least one element selected from Fe and Co; x, y, z and u represent are atomic percent individually defined as $2 \leqq x$, $2 \leqq x+y \leqq 20$, $0.001 \leqq z \leqq 10$, $0 \leqq u \leqq 20$; and a principal phase of the magnetic material having a $TbCu_7$ type crystal structure.

20 Claims, 2 Drawing Sheets

MAGNETIC MATERIAL AND BONDED MAGNET

BACKGROUND OF THE INVENTION

1. Field of the Invention

This invention relates to a magnetic material and also to a bonded magnet.

2. Description of the Related Art

There is known, as a high performance permanent magnet comprising a rare earth element, an Sm—Co-based magnet and an Nd—Fe—B-based magnet, which are now mass-produced. These magnets contain a large amount of Fe or Co thereby to increase the saturation magnetic flux density thereof. Meanwhile, the inclusion of rare earth elements in these magnets is effective in developing a very large magnetic anisotropy originating from the behavior of 4f electrons in the crystal field. As a result, the coercive force of the magnet can be increased thus making it possible to obtain a high performance magnet. The high performance magnet thus obtained is now mainly utilized in the manufacture of a speaker, a motor, a measuring instrument or other electric devices.

There have been an increasing demand for the miniaturization of electric devices of various kinds. In order to meet these demands, there has been desired to develop a permanent magnet of higher performance having an improved maximum magnetic energy product.

In view of these demands, the present inventors have already proposed a magnetic material of high saturation magnetic flux density, which comprises a $TbCu_7$ phase as a main phase and has a high Fe concentration (Jpn. Pat. Appln. KOKAI Publication No. 6-172936).

SUMMARY OF THE INVENTION

Accordingly, an object of the present invention is to provide a magnetic material comprising a $TbCu_7$ phase as a main phase and having a large residual magnetic flux density.

Another object of this invention is to provide a bonded magnet comprising a $TbCu_7$ phase as a main phase and having a large residual magnetic flux density.

Namely, according to the present invention, there is provided a magnetic material having a composition represented by a general formula:

$$R1_xR2_yB_zA_uM100\text{-}x\text{-}y\text{-}z\text{-}u$$

wherein R1 is at least one element selected from rare earth elements including Y; R2 is at least one element selected from Zr, Hf and Sc; A is at least one element selected from H, N, C and P; M is at least one element selected from Fe and Co; x, y, z and u are atomic percent individually defined as $2 \leqq x$, $2 \leqq x+y \leqq 20$, $0.001 \leqq z \leqq 10$, $0 \leqq u \leqq 20$, and a principal phase of the magnetic material having a $TbCu_7$ type crystal structure.

In the case where each of the crystal grains behaves individually in a isotropic magnetic material, the ratio (Br/Bs) of the residual magnetic flux density (Br) to the saturation magnetic flux density (Bs) would not exceed 0.5 in general. However, once the refined crystal grains are bonded by way of an exchange interaction to each other through the grain boundary thereof, the ratio (Br/Bs) may exceed 0.5 even if the magnetic material is isotropic.

The magnetic material according to the present invention is represented by the general formula of: $R1_xR2_yB_zA_uM_{100-x-y-z-u}$. The magnetic material is featured in that boron (B) is used as a component in an amount of 0.001 to 10 at.% and that a $TbCu_7$ phase is used as a principal phase. In the case of the magnetic material, the exchange interaction between the crystal grains is promoted, so that the residual magnetic flux density is increased. The reason for this is considered to be attributed to the behavior of boron as explained below.

Namely, boron will be entrapped within a magnetic material by the intrusion of boron into the interstitial site of the $TbCu_7$ phase or by the bonding of boron with a rare earth element or with a transition metal element thus forming a crystal boundary phase. The entrapment of boron in a magnetic material contributes to the refinement of crystal boundary and gives an influence to the boundary structure, thereby promoting the exchange interaction between the crystal grains. Hence making it possible to form a magnetic material having the ratio (Br/Bs) exceeding 0.5 thus improving the residual magnetic flux density of the magnetic material.

Further, according to this invention, there is also provided a bonded magnet, which is featured in that it comprises particles of a magnetic material having a composition represented by a general formula:

$$R1_xR2_yB_zA_uM100\text{-}x\text{-}y\text{-}z\text{-}u$$

wherein R1 is at least one element selected from rare earth elements including Y; R2 is at least one element selected from Zr, Hf and Sc; A is at least one element selected from H, N, C and P; M is at least one element selected from Fe and Co; x, y, z and u are atomic percent individually defined as $2 \leqq x$, $2 \leqq x+y \leqq 20$, $0.001 \leqq z \leqq 10$, $0 \leqq u \leqq 20$, and a principal phase of said magnetic material being of a $TbCu_7$ type crystal structure; and a binder.

Since the bonded magnet having such a feature comprises a magnetic material having a high residual magnetic flux density, it is possible to attain a large maximum energy product.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
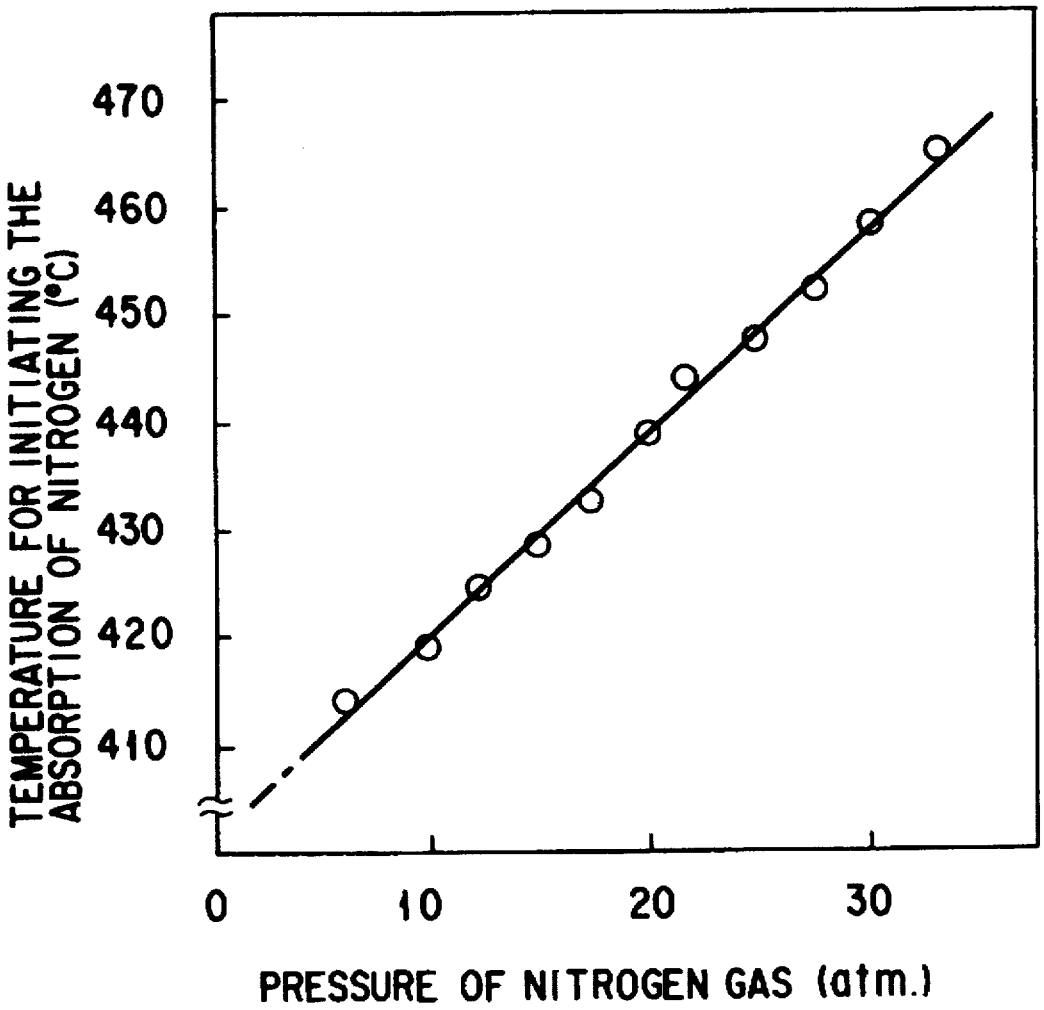
FIG. 1 is a graph showing a relationship between nitrogen gas pressure employed in the nitriding treatment of alloy powder to be employed in this invention and the temperature at the initiation of the nitrogen absorption.

This invention will be further explained in detail as follows.

A magnetic material according to this invention comprises a composition represented by a general formula:

$R1_xR2_yB_zA_uM100\text{-}x\text{-}y\text{-}z\text{-}u$ wherein R1 is at least one element selected from rare earth elements including Y; R2 is at least one element selected from Zr, Hf and Sc; A is at least one element selected from H, N, C and P; M is at least one element selected from Fe and Co; x, y, z and u are atomic percent individually defined as $2 \leqq x$, $2 \leqq x+y \leqq 20$, $0.001 \leqq z \leqq 10$, $0 \leqq u \leqq 20$; and a principal phase of said magnetic material having a $TbCu_7$ type crystal structure.

The aforementioned principal phase is a phase which occupies the maximum volume ratio in the magnetic material, and the principal phase having the aforementioned $TbCu_7$ type crystal structure influences the magnetic properties of the magnetic material. Therefore, if the content of this principal phase in the magnetic material of this invention is decreased, the features of this principal phase would not be sufficiently reflected in the magnetic material, so that the content of this principal phase should preferably be at least 50 volume percent or more.

The ratio (c/a) of lattice constants a and c of the aforementioned $TbCu_7$ type crystal structure in the magnetic material of this invention should preferably be 0.847 or more. This ratio (c/a) is closely related to the concentrations of Fe and Co in the $TbCu_7$ phase, i.e., as the c/a ratio is increased, the concentrations of Fe and Co will also be increased correspondingly. Increases in concentration of Fe and Co in the $TbCu_7$ phase bring about an increase in saturation magnetic flux density of a magnetic material, thus improving the magnetic properties thereof. The development of these effects is more conspicuous in the case of a magnetic material having a c/a ratio of 0.847 or more. The specific value of the c/a ratio can be controlled by suitably adjusting the mixing ratio of components constituting a magnetic material or by suitably selecting the manufacturing method of magnetic material.

The followings are detailed explanations on (1) the function of each component constituting the magnetic material represented by the aforementioned general formula and the reasons for limiting the content of each component; (2) the manufacturing method of a magnetic material where the A element is not contained; (3) the manufacturing method of a magnetic material where N is incorporated as the A element; (4) the manufacturing method of a magnetic material where C is incorporated as the A element; and (5) the manufacturing method of a magnet.

(1) The function of each component constituting the magnetic material represented by the aforementioned general formula and the reasons for limiting the content of each component:

(1-1) R1 elements:

Examples of the rare earth element constituting the R1 elements are La, Ce, Pr, Nd, Sm, Eu, Gd, Tb, Dy, Ho, Er, Tm, Lu and Y. These elements may be employed singly or as a mixture of two or more kinds. R1 elements are effective in giving an increased magnetic anisotropy and hence an increased coercive force to the magnetic material. In particular, it is preferable that 50 atomic percent or more of R1 elements employed is occupied by Sm. In this case, R1 elements other than Sm should preferably be occupied by Pr and Nd.

If the content of R1 elements is less than 2 atomic percent, the magnetic anisotropy of the magnetic material would be extremely decreased, thus making it very difficult to obtain a magnetic material having a large coercive force. Meanwhile, if the content of R1 elements is excessively incorporated, the saturation magnetic flux density of the magnetic material would be decreased. Therefore, the content (x) of R1 element should preferably be $4x \leqq 16$.

(1-2) R2 elements:

As for the R2 elements, at least one element selected from the group consisting of Zr, Hf and Sc may be employed. These R2 elements mainly occupy the rare earth element site of the main phase thereby to function to reduce the average atomic radius of the rare earth element site. As a result, it is possible to increase the contents of Fe and Co in the $TbCu_7$ phase constituting the principal phase. Therefore, the content (y) of R2 element should preferably be $0.1 \leqq y \leqq 10$, more preferably $1 \leqq y \leqq 3$.

Meanwhile, if the total amount of R1 element and R2 element is less than 4 atomic percent, the precipitation of α-Fe (Co) becomes prominent so that it becomes very difficult to obtain a magnetic material having a large coercive force. On the other hand, if the total amount of R1 element and R2 element exceeds 20 atomic percent, the saturation magnetic flux density of the magnetic material would be decreased.

Therefore, a preferable total amount (x+y) of R1 element and R2 element should be $4 \leqq x+y \leqq 16$.

(1-3) B (boron):

Boron is effective in obtaining a magnetic material having a large residual magnetic flux density as aimed at by this invention. If the content of boron is less than 0.001 atomic percent, it would be difficult to obtain a magnetic material having a large residual magnetic flux density. On the other hand, if the content of boron exceeds 10 atomic percent, the formation of $R_2Fe_{14}B$ phase would become prominent and therefore the magnetic properties of the magnetic material would be deteriorated. Therefore, a preferable content (z) of boron is $0.01 \leqq z \leqq 4$, more preferably $0.1 \leqq z \leqq 3$.

(1-4) A elements:

As for the A elements, at least one element selected from the group consisting of H, N, C and P may be employed. The A elements are mainly positioned at a site between lattices of the principal phase thereby to function to increase the Curie temperature and magnetic anisotropy of the principal phase as compared with a magnetic material not containing any of A elements.

The effect of A elements may be expected even if the content thereof is very little. However, if the content of A elements exceeds 20 atomic percent, the precipitation of α-Fe (Co) becomes prominent. Therefore, the content (u) of A elements should preferably be $2 \leqq u \leqq 20$, more preferably $5 \leqq u \leqq 10$.

(1-5) M elements:

As for the M elements, at least one element selected from the group consisting of Fe and Co may be employed. The M elements function to increase the saturation magnetic flux density of the magnetic material.

The effect of M elements to increase the saturation magnetic flux density can be expected if the content thereof is 70 atomic percent or more. A portion of M elements may be substituted by at least one T element selected from the group consisting of Cr, V, Mo, W, Mn, Ni, Sn, Ga, Al and Si. It is possible with this substitution of T element to increase the ratio of the principal phase in the total volume of the magnetic material or to increase the total amount of M and T elements in the principal phase. In addition to that, the coercive force of the magnetic material can be increased by the substitution of T element.

However, if M elements are excessively substituted by T elements, the deterioration in saturation magnetic flux density of the magnetic material may be caused. Therefore, the amount of T elements substituting the M elements should preferably be limited to 20 atomic percent or less of the M elements. Further, in view of obtaining a magnetic material having a high saturation magnetic flux density, the content of Fe in the total amount of M and T elements should preferably be controlled to 50 atomic percent or more.

The magnetic material according to this invention may contain an unavoidable impurities such as oxides.

(2) the manufacturing method of a magnetic material:

(2-1):

First of all, an ingot comprising predetermined amounts of R1, R2 and M elements (including, if required, T elements substituting a portion of the M elements) is prepared by way of an arc melting or a high frequency melting. This ingot is cut down into small pieces, which are then melted together with a prescribed amount of boron (B) by way of high frequency induction heating. The resultant hot melt is then ejected over a single roll rotating at a high speed to manufacture a quenched thin strip. It is also possible to manufacture a quenched thin strip from a hot melt of an ingot containing boron in advance.

If the temperature of the aforementioned hot melt is too high, an $R_2Fe_{14}B$ phase may be generated in the quenched thin strip. Therefore, the temperature of the hot melt should preferably be in the range of 900° to 1500° C.

As for the method of quenching the hot melt, any other methods such as a double roll method, a rotating disk method or gas atomizing method may be employed in place of the aforementioned single roll method.

(2-2):

To a powdery raw material mixture comprising predetermined amounts of R1, R2, B and M elements (including, if required, T elements substituting a portion of the M elements) is given a mechanical energy so as to prepare a magnetic material by way of a mechanical alloying method or a mechanical grinding method wherein the raw material mixture is alloyed through a solid phase reaction.

The quenching step and the solid phase reaction step in the manufacture of the magnetic material should desirably be performed in an inert gas atmosphere such as He gas atmosphere. When the quenching or solid phase reaction is performed in such an atmosphere, it is possible to manufacture a magnetic material while avoiding the deterioration of magnetic properties originating from oxidation.

The magnetic material produced by the aforementioned method may be heat-treated if required in an inert gas atmosphere such as Ar or He, or in vacuum at a temperature of 300° to 1,000° C. for a period of 0.1 to 10 hours. It is possible with such a heat treatment to improve the magnetic properties such as coercive force of the magnetic material.

(3) The method of manufacturing a magnetic material where N is incorporated as the A element:

The alloyed materials obtained by way of the methods of aforementioned (2-1) and (2-2) are pulverized with a ball mill, a braun mill, stamp mill or a jet mill to obtain an alloy powder having an average particle diameter ranging from several microns to several tens microns, which is then heat-treated in a nitrogen gas atmosphere (nitriding treatment) thereby to obtain a magnetic material. In the case of the alloy material manufactured by way of the mechanical alloying method or the mechanical griding method as described in the aforementioned method (2), the pulverizing step described above may be omitted, since the alloy material manufactured in the aforementioned method (2) is powdery from the beginning.

When the alloy material (a thin strip) that can be obtained by the liquid quenching method of the aforementioned method (1) is to be employed as a raw material for the alloy powder to be subjected to the aforementioned nitriding treatment, it is preferable to employ a thin strip having a coercive force (iHc) of 56 kA/m(700 Oe) or less, more preferably 20 kA/m(250 Oe) or less as measured immediately after the quenching, or a thin strip having a thickness of 30 μm or less. The former thin strip can be obtained by increasing the rotation speed of a roll when the single roll method is employed as the liquid quenching method. The latter thin strip can be obtained by adjusting the gap between the nozzle for ejecting a hot melt when the single roll method is employed as the liquid quenching method. It is possible to obtain a magnetic material having a further improved residual magnetic flux density if an alloy powder obtained through the pulverization of such a thin strip is subjected to a nitriding treatment.

The nitriding treatment in this case may be preferably performed in a nitrogen gas atmosphere of 0.001 to 100 atm. and at a temperature of 200° to 700° C. The duration of this nitriding treatment may be 0.1 to 300 hours under such pressure and temperature conditions.

In particular, it is desired that the nitrogen gas pressure p (atm.) during the nitriding treatment is not less than 2 atm. and satisfys the equation of: $2p+400 \leqq T \leqq 2p+420$ (where T represents the nitriding treatment temperature (°C.)).

Namely, the present inventors have found out that there is a relationship between the nitrogen gas pressure and the temperature for initiating the absorption of nitrogen as shown in FIG. 1. The temperature of initiating the absorption of nitrogen is meant herein a temperature at which the absorption of nitrogen can be initiated when the temperature of a nitrogen-containing gas is raised gradually from room temperature. The temperature at which α-Fe phase precipitates in the magnetic material is almost the same as the temperature at which the absorption of nitrogen can be initiated. Therefore, if the nitrogen gas pressure is raised up higher, the precipitation of the α-Fe phase can be minimized as compared with the case where the nitrogen gas pressure is relatively low even if the nitriding treatment is performed at a high temperature. Accordingly, if the nitriding treatment is performed under the aforementioned conditions, the diffusion of nitrogen into the interior of the alloy powder can be facilitated while inhibiting an excessive precipitation of the α-Fe phase, thereby obtaining a magnetic material excellent in magnetic properties.

If the nitriding treatment is performed under the conditions where the nitrogen gas pressure is set to 2 atm. or more and the temperature is set to $T>2p+400$, the uptake of nitrogen per unit time will be reduced taking a long period of nitriding treatment time thus inviting an increase in manufacturing cost. On the other hand, if the nitriding treatment is performed under the conditions where the nitrogen gas pressure is set to 2 atm. or more and the temperature is set to $T>2p+420$, the precipitation of the α-Fe phase will be increased even if the nitrogen gas pressure is increased, thus possibly deteriorating the magnetic properties of the magnetic material.

As for the atmosphere for the nitriding treatment, a nitrogen compound gas such as ammonia gas may be employed in place of nitrogen gas. If ammonia gas is employed, it is possible to increase a nitride reaction.

If a heat treatment is performed as a pretreatment for the nitriding treatment under a hydrogen gas atmosphere of 0.001 to 100 atm. and at a temperature of 100° to 700° C., or if a gas mixture comprising nitrogen gas and hydrogen gas is employed, the aforementioned nitriding can be performed in high efficiency.

The nitrogen gas atmosphere to be employed in the aforementioned nitriding treatment may be mixed with another kind of gas containing no nitrogen. However, if oxygen is to be mixed with the nitrogen gas atmosphere, the partial pressure of oxygen should preferably be controlled to 0.02 atm or less so as to avoid the deterioration of magnetic properties that might be caused by the formation of oxides during the heat treatment.

A nitrogen compound such as RN (wherein R is at least one kind selected from the aforementioned R1 and R2) may be employed as a raw material in the step of preparing the alloy powder, the nitrogen compound being subsequently subjected to a solid phase reaction so as to prepare a magnetic material containing nitrogen as the aforementioned A element.

(4) The method of manufacturing a magnetic material where C is incorporated as the A element:

An alloyed material obtained by way of the methods of aforementioned (2-1) and (2-2) is pulverized with a ball mill, a braun mill, stamp mill or a jet mill to obtain an alloy powder having an average particle diameter ranging from several microns to several tens microns, which is then heat-treated in a carbon-containing gas atmosphere such for example as methane gas thereby to obtain a magnetic material containing carbon. In the case of the alloy material manufactured by way of the mechanical alloying method or the mechanical griding method as described in the aforementioned method (2), the pulverizing step described above may be omitted, since the alloy material manufactured in the aforementioned method (2) is powdery from the beginning.

When an alloy material (a thin strip) that can be obtained by the liquid quenching method of the aforementioned method (1) is to be employed as a raw material for the alloy powder to be subjected to the aforementioned nitriding treatment, it is preferable to employ a thin strip having a coercive force (iHc) of 56 kA/m(700 Oe) or less, more preferably 20 kA/m(250 Oe) or less as measured immediately after the quenching, or a thin strip having a thickness of 30 μm or less. It is possible to obtain a magnetic material having a further improved residual magnetic flux density if an alloy powder obtained through the pulverization of such a thin strip is subjected to a heat treatment in a carbon-containing gas atmosphere.

The heat treatment in this case may be preferably performed in carbon-containing gas atmosphere of 0.001 to 100 atm. and at a temperature of 200° to 700° C. The duration of this heat treatment may be 0.1 to 300 hours under such pressure and temperature conditions.

A magnetic material containing carbon as the A element may also be manufactured by adding carbon in the step of preparing the alloy instead of employing a carbon-containing gas such as methane gas.

A magnetic material containing phosphorus as the A element may also be manufactured by adding phosphorus in the step of preparing the alloy.

(5) Manufacturing method of a permanent magnet:

When a permanent magnet is to be manufactured, an alloy powder obtained through the pulverization of a magnetic material is generally employed. However, if the raw material is already pulverized in the manufacturing step of the magnetic material, the aforementioned pulverization step may be omitted. A permanent magnet can be produced using such an alloy powder as explained below.

(5-1):

An alloy powder as described above is mixed with a binder, and then compression-molded to prepare a bonded magnet.

As for the alloy powder, it is preferable to employ the one which contains not more than 5 volume percent, more preferably not more than 2 volume percent of fine powder having a particle diameter of 2.8 μm or less. Because, such a fine powder is large in surface area rendering it to be easily oxidized and may become a cause for generating α-Fe phase through a solid phase reaction. Therefore, by making use of an alloy powder containing a least amount of such a fine powder, a bonded magnet having an improved magnetic properties can be obtained.

The removal of such a fine powder from the alloy powder can be performed for example by making use of a method using an air classifier, or a method of dispersing the alloy powder in a solvent so as to float the fine powder which is subsequently taken out.

As for the binder, a synthetic resin such for example as epoxy resin or nylon resin may be employed. If a thermosetting resin such as epoxy resin is to be employed as the binder, a curing treatment at a temperature of 100° to 200° C. should preferably be performed after the compression molding. Whereas, if a thermoplastic resin such as nylon resin is to be employed as the binder, the employment of an injection molding method is preferable.

A bonded magnet having a high magnetic flux density can be obtained by uniformly arraying the crystal orientation of the alloy powder by impressing a magnetic field onto the alloy powder in the compression molding step.

The bonded magnet may contain another kind of magnetic material powder having an $R_2Fe_{14}B$ phase (wherein R is at least one element selected from rare earth elements including Y) as a principal phase.

In the occasion of performing the nitriding treatment of the alloy powder consisting of the aforementioned general formula: $R1_xR2_yB_zA_uM_{100-x-y-z-u}$ (u=0), the particle diameter of the powder should preferably be relatively small, e.g. 50 μm or less, more preferably 30 μm or less in view of sufficiently and uniformly nitriding the alloy powder including the inside of each particle. However, as explained above, it is preferable to employ the alloy powder which contains not more than 5 volume percent of fine powder having a particle diameter of 2.8 μm or less. It should be noted however that if a bonded magnet is to be manufactured using fine alloy powder having a particle diameter of 50 μm or less, it would become difficult to increase the packing density of the magnet. As a result, it may become difficult to improve the magnetic properties of the bonded magnet.

On the other hand, if a magnetic material of $R_2Fe_{14}B$ system is pulverized too extremely, the magnetic properties of the magnetic material will be deteriorated. Accordingly, the $R_2Fe_{14}B$ system powder having a relatively large particle diameter for example of 50 μm or more may be employed together with the powder having a general formula: $R1_xR2_yB_zA_uM_{100-x-y-z-u}$ and a relatively small particle diameter thereby making it possible to increase the packing density and hence to obtain a bonded magnet excellent in magnetic properties.

In this case, the mixing ratio (A/B) by weight between the alloy powder (A) having the general formula represented by $R1_xR2_yB_zA_uM_{100-x-y-z-u}$ and the alloy powder (B) having the $R_2Fe_{14}B$ phase as a principal phase should preferably be 0.1 to 10. If the mixing ratio (A/B) by weight is less than 0.1, the content in the bonded magnet of the alloy powder (A) exhibiting excellent magnetic properties such as a residual magnetic flux density becomes too little to expect a sufficient degree of magnetic properties of the bonded magnet. On the other hand, if the mixing ratio (A/B) by weight exceeds 10, it becomes difficult to improve the closest packing property of the bonded magnet.

(5-2):

An alloy powder as described above is mixed with a low melting point metal or a low melting point alloy, and then compression-molded to prepare a metal bonded magnet.

As for the low melting point metal, it is possible to employ a metal such as Al, Pb, Sn, Zn, Cu or Mg. As for the low melting point alloy, it is possible to employ an alloy comprising any of these metals.

A metal bonded magnet having a high magnetic flux density can be obtained by uniformly arraying the crystal orientation of the alloy powder by impressing a magnetic field onto the alloy powder in the compression molding step.

(5-3):

An alloy powder as described above is formed a molded body having a high density by way of a hot press or a hot isostatic pressing (HIP), thereby manufacturing a permanent magnet.

A permanent magnet having a high magnetic flux density can be obtained by uniformly arraying the crystal orientation of the alloy powder by impressing a magnetic field onto the alloy powder in the compression step.

Furthermore, a permanent magnet having the alloy powder orientated in the direction of the axis of easy magnetization can be obtained by subjecting the resultant pressed body after the compression step to a plastic deformation working while compressing the pressed body at a temperature of 300° to 700° C.

(5-4):

An alloy powder as described above is sintered to manufacture a permanent magnet.

This invention will be explained further with reference to preferred examples of this invention.

(EXAMPLE 1)

First of all, an ingot was prepared by using as raw materials Sm, Zr, Co and Fe of high purity, and subjecting the raw materials to an arc melting in an Ar atmosphere. The composition of the resultant ingot was composed of 7.5 at. % of Sm, 2.5 at. % of Zr, 27 at. % of Co and the balance of Fe. This ingot was cut down into small pieces each having about 20 g, which were then charged together with about 60 mg of boron (B) in a quartz nozzle and allowed to melt by way of high frequency induction heating in an argon atmosphere. The resultant hot melt was then ejected over a single copper roll rotating at a peripheral speed of 40 m/s to manufacture a thin alloy strip. The temperature of the hot melt at the moment of ejection was set to 1300° C. When the resultant thin alloy strip was analyzed by way of inductively coupled plasma (ICP), it was found that the alloy strip contained 1.88 at. % of boron and had a composition of $SM_{7.35}Zr_{2.45}Co_{26.5}B_{1.88}Fe_{balance}$. The alloy strip was then vacuum-encapsulated in a quartz tube and then heat-treated at a temperature of 720° C. for 15 minutes.

The phases in the thin alloy strip formed after the aforementioned heat treatment were examined by way of an X-ray diffraction. It was confirmed as a result that all of the diffraction peaks excepting the minute diffraction peak of α-Fe on the diffraction pattern could be indexed by $TbCu_7$ type crystal structure of hexagonal system, indicating that the principal phase of the thin alloy strip was constituted by the $TbCu_7$ phase. Further, it was found out as a result of the X-ray diffraction that the lattice constants a and c of the $TbCu_7$ phase could be evaluated as being a=0.4853 nm; c=0.4184 nm, the ratio of lattice constants c/a being 0.8621.

The thin alloy strip obtained after the aforementioned heat treatment was then pulverized in a mortar into powder having particle diameter of 100 μm or less. The resultant powder of magnetic material was mixed with 2% by weight of epoxy resin and then compression-molded at a pressure of 8,000 kg/cm$^2$. The resultant molded body was cured at a temperature of 150° C. for 2.5 hours to obtain a bonded magnet.

The magnetic properties at room temperature of the bonded magnet thus obtained was then measured to find out that the residual magnetic flux density thereof was 0.75 T, the coercive force thereof was 210 kA/m and the maximum energy product thereof was 64 kJ/m$^3$.

(EXAMPLE 2)

The thin alloy strip obtained in Example 1 was vacuum-encapsulated in a quartz tube and then heat-treated at a temperature of 720° C. for 15 minutes. The thin alloy strip thus heat-treated was then pulverized in a mortar into powder having particle diameter of 32 μm or less and heat-treated (nitriding treatment) in a nitrogen gas atmosphere of 1 atm. at a temperature of 440° C. for 65 hours to manufacture magnetic material powder. The composition of the resultant magnetic material powder was found to be $SM_{6.76}Zr_{2.25}Co_{24.35}B_{1.70}N8.12Fe_{balance}$.

Figure 2:
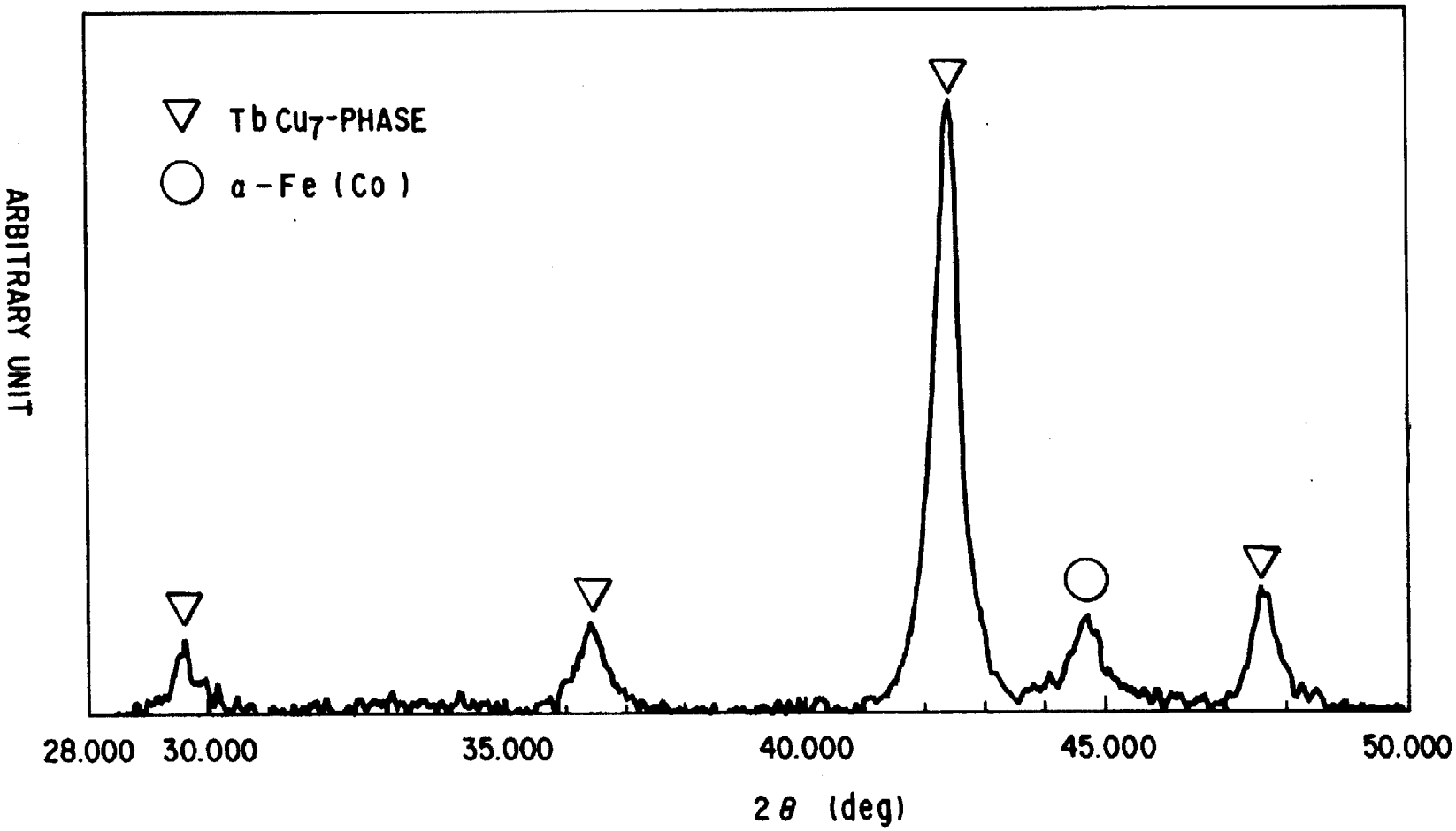
FIG. 2 is a graph showing an X-ray diffraction pattern of the magnetic material powder of Example 2.

The phases in the aforementioned magnetic material powder were examined by way of an X-ray diffraction to obtain an X-ray diffraction pattern as shown in FIG. 2. It was confirmed as shown in FIG. 2 that all of the diffraction peaks excepting the minute diffraction peak of α-Fe on the diffraction pattern could be indexed by $TbCu_7$ type crystal structure of hexagonal system, indicating that the principal phase of the magnetic material powder was constituted by the $TbCu_7$ phase. Further, it was found out as a result of the X-ray diffraction that the lattice constants a and c of the $TbCu_7$ phase could be evaluated as being a=0.4927 nm; c=0.4255 nm, the ratio of lattice constants c/a being 0.8636.

The magnetic material powder was allowed to float and suspended matter was removed, thereby the content of minute powder having a particle diameter of 3.8 μm or less in the magnetic material powder was reduced to not more than 5 vol. %. The resultant powder of magnetic material after the removal of the minute powder was mixed with 2% by weight of epoxy resin and then compression-molded at a pressure of 8,000 kg/cm$^2$. The resultant molded body was cured at a temperature of 150° C. for 2.5 hours to obtain a bonded magnet.

The magnetic properties at room temperature of the bonded magnet thus obtained was then measured to find out that the residual magnetic flux density thereof was 0.75 T, the coercive force thereof was 560 kA/m and the maximum energy product thereof was 81 kJ/m$^3$.

(EXAMPLES 3 to 10)

First of all, eight kinds of ingots were prepared using as raw materials Sm, Nb, Pr, Dy, Zr, Hf, V, Ni, Cr, Al, Ga, Mo, W, Si, Co and Fe of high purity, and subjecting the raw materials to an arc melting in an Ar atmosphere. Each of these ingots was cut down into small pieces, which were then charged together with boron (B) in a quartz nozzle and allowed to melt by way of high frequency induction heating in an argon atmosphere. Each of these resultant hot melts was then ejected over a single copper roll rotating at a peripheral speed of 40 m/s to manufacture eight kinds of thin alloy strips. Each of the alloy strips was then vacuum-encapsulated in a quartz tube and subsequently heat-treated at a temperature of 720° C. for 15 minutes. Each of the thin alloy strips thus heat-treated was then pulverized in a mortar into powder having particle diameter of 32 μm or less and heat-treated (nitriding treatment) in a nitrogen gas atmosphere of 1 atm. at a temperature of 440° C. for 65 hours to manufacture eight kinds of magnetic material powder as shown in Table 1.

These eight kinds of magnetic material powder samples were examined by way of an X-ray diffraction to confirm that the principal phase of every magnetic material powder samples were constituted by the $TbCu_7$ phase. Further, it was found out as a result of the X-ray diffraction that the ratio of lattice constants (c/a) were in the range of from 0.854 to 0.876.

Then, by repeating the same procedures as described in Example 2 using the aforementioned magnetic material powder, eight kinds of bonded magnets were prepared.

Then, the magnetic properties at room temperature, i.e. the residual magnetic flux density, coercive force and maximum energy product of these bonded magnets thus obtained were measured, the results being shown also in Table 1 as follows.

TABLE 1

| | Composition (bal. = balance) | Residual flux density (T) | Coercive force (kA/m) | Maximum energy product ($kJ/m^3$) |
|---|---|---|---|---|
| Example 3 | $Sm_5Nd_2Zr_2Cr_1Mo_2Si_1Co_{21}B_{1.1}N_8Fe_{bal.}$ | 0.70 | 590 | 76 |
| Example 4 | $Sm_6Pr_1Zr_2V_2W_1Ni_3Co_{16}B_{0.8}N_7Fe_{bal.}$ | 0.73 | 550 | 81 |
| Example 5 | $Sm_7Er_1Zr_1Hf_1Mo_2Ga_1Co_{19}B_{0.5}N_8Fe_{bal.}$ | 0.68 | 615 | 72 |
| Example 6 | $Sm_6Nd_1Dy_1Zr_2Co_{14}B_{1.3}C_1N_8Fe_{bal.}$ | 0.69 | 580 | 74 |
| Example 7 | $Sm_7Nd_2Zr_2Co_{14}C_5B_{1.2}N_7Fe_{bal.}$ | 0.76 | 525 | 82 |
| Example 8 | $Sm_5Nd_2Zr_2Al_3Co_{17}B_{1.9}C_2N_7Fe_{bal.}$ | 0.74 | 540 | 80 |
| Example 9 | $Sm_7Nd_1Zr_2W_2Sn_1Co_{22}B_{1.3}N_8Fe_{bal.}$ | 0.70 | 585 | 77 |
| Example 10 | $Sm_8Pr_1Zr_2Sc_1Mo_2Ga_1Co_{20}B_{0.5}N_9Fe_{bal.}$ | 0.72 | 560 | 80 |

As shown in Table 1, the residual magnetic flux density, coercive force and maximum energy product of these bonded magnets according to Examples 3 to 10 were all high, thus indicating the excellent magnetic properties of these bonded magnets.

(COMPARATIVE EXAMPLE 1)

First of all, a thin alloy strip was prepared using as raw materials Sm, Zr, Co and Fe of high purity in a predetermined ratio, and treating the raw materials in the same conditions as in Example 1 to prepare a thin alloy strip. Then, after a heat treatment in vacuum, the alloy strip was subjected to a nitriding treatment in the same manner as in Example 2 to manufacture a magnetic material powder. By the way, the composition of the ingot was composed of 7.5 at. % of Sm, 2.5 at. % of Zr, 27 at. % of Co and the balance of Fe. The content of boron was adjusted to be 14 at. %.

When the resultant magnetic material powder was analyzed by way of X-ray diffraction, the formations of a $TbCu_7$ phase, a $R_2Fe_{14}B$ phase and an α-Fe phase were confirmed. The ratio in diffractive intensity of the main peaks of these phases were: $TbCu_7$ phase: $R_2Fe_{14}B$ phase: α-Fe phase= 1:33:48.

Then, by repeating the same procedures as described in Example 1 using the aforementioned magnetic material powder, a bonded magnet was prepared. The magnetic properties at room temperature of the bonded magnet thus obtained were then measured to find out that the residual magnetic flux density thereof was 0.12 T, the coercive force thereof was 32 kA/m and the maximum energy product thereof was 1.0 $kJ/m^3$, indicating poor magnetic properties. These poor magnetic properties may be attributed to the facts that the content of boron (B) in the magnetic material exceeded the limitation of this invention (not more than 10 at. %), thus giving rise to the precipitations in large quantity of the α-Fe phase and $R_2Fe_{14}B$ phase as apparent from the aforementioned results of the X-ray diffraction.

(COMPARATIVE EXAMPLE 2)

A thin alloy strip was prepared using as raw materials Sm, Zr, Co and Fe of high purity in a predetermined ratio, and treating the raw materials in the same conditions as in Example 1 to prepare a thin alloy strip. Then, after a heat treatment in vacuum, the alloy strip was subjected to a nitriding treatment in the same manner as in Example 2 to manufacture a magnetic material powder. By the way, the composition of the ingot was composed of 7.5 at. % of Sm, 2.5 at. % of Zr, 27 at. % of Co and the balance of Fe. Boron was not added in this Comparative Example.

When the resultant magnetic material powder was analyzed by way of X-ray diffraction, the $TbCu_7$ phase was found to be a principal phase and the lattice constant ratio (c/a) of the $TbCu_7$ phase was found to be 0.861.

Then, by repeating the same procedures as described in Example 1 and using the aforementioned magnetic material powder, a bonded magnet was prepared. The magnetic properties at room temperature of the bonded magnet thus obtained were then measured to find out that the residual magnetic flux density thereof was 0.60 T, the coercive force thereof was 550 kA/m and the maximum energy product thereof was 57 $kJ/m^3$, indicating poor magnetic properties as compared with those of Example 2. These poor magnetic properties may be attributed to the fact that since boron was not added at all, the residual magnetic flux density is caused to deteriorated as compared with Example 2 and hence causing the maximum energy product to diminish as compared with Example 2.

(EXAMPLES 11-1 to 11-3)

First of all, an ingot was prepared using as raw materials Sm, Zr, Co and Fe of high purity, and subjecting the raw materials to an arc melting in an Ar atmosphere. The composition of the resultant ingot was composed of 7.5 at. % of Sm, 2.5 at. % of Zr, 27.0 at. % of Co and the balance of Fe. This ingot was then charged together with a prescribed amount of boron (B) in a quartz nozzle and allowed to melt by way of high frequency induction heating in an argon atmosphere. The resultant hot melt was then ejected over a single copper roll having a diameter of 300 mm and rotating at a peripheral speed of 40 m/s to manufacture a thin alloy strip. The temperature of the hot melt at the moment of ejection was set to 1350° C. When the resultant thin alloy strip was analyzed by way of ICP, it was found that the alloy strip contained 1.9 at. % of boron and had a composition of $SM_{7.4}Zr_{2.4}Co_{29.8}B_{1.9}Fe_{balance}$. When the coercive force of the thin alloy strip thus obtained was measured using a vibrating test type magnetometer (VSM), the coercive force was found to be in the range of 12 to 68 kA/m.

Then, three kinds of thin alloy strips, each being differed in coercive force, i.e. 12 kA/m, 36 kA/m and 68 kA/m were selected and heat-treated in an inert atmosphere (Ar: 0.9 atm.) at a temperature of 700° C. for 30 minutes. These thin alloy strips were pulverized with a ball mill into particles having an average particle diameter of 20 μm or so and then heat-treated (nitriding treatment) in a nitrogen gas atmosphere of 1 atm. at a temperature of 450° C. for 50 hours to manufacture three kinds of magnetic material powder, each having a composition shown in the following Table 2.

These three kinds of magnetic material powder samples were examined by way of an X-ray diffraction to confirm that the principal phase of every magnetic material powder samples were constituted by the $TbCu_7$ phase. Further, it was found out as a result of the X-ray diffraction that the ratio of lattice constants (c/a) were in the range of from 0.854 to 0.876.

When the magnetic properties (the residual magnetic flux density and the maximum energy product) of each of the magnetic material powder were examined using a vibrating test type magnetometer (VSM). These magnetic properties were calculated assuming the density of the magnetic material powder as being 7.74g/cm$^3$ and performing a compensation with the demagnetizing factor being set to 0.15, the results being shown in Table 2.

(EXAMPLES 12 to 15)

First of all, four kinds of ingots were prepared using as raw materials Sm, Nb, Pr, Dy, Zr, Hf, Mn, Ni, Cr, Al, Ga, Mo, W, Si, Nb, Co and Fe of high purity, subjecting the raw materials to an arc melting in an Ar atmosphere, and then pouring each melt into a mold. Each of these ingots was then charged together with boron (B) in a quartz nozzle and allowed to melt by way of high frequency induction heating in an argon atmosphere. Each of these hot melts thus obtained was then ejected over a single copper roll having a diameter of 300 mm and rotating at a peripheral speed of 40 m/s to manufacture four kinds of thin alloy strips. The temperature of the hot melt at the moment of ejection was set to 1320° C. When the composition of the resultant thin alloy strips were analyzed by way of ICP, it was found that each of the alloy strips contained 1.1 at. %, 1.6 at. %, 0.5 at. %, 1.7 at. % of boron respectively and had the compositions of $SM_{7.9}Zr_{2.2}Ni_{3.3}Ga_{1.1}Co_{22.0}B_{1.1}Fe_{balance}$ (Example 12), $SM_{6.5}Nd_{1.1}Zr_{2.6}Mo_{2.2}Cr_{1.1}Si_{1.1}Co_{25.0}B_{1.6}Fe_{balance}$ (Example 13), $SM_{7.4}Pr_{1.1}Zr_{1.6}Hf_{0.5}W_{0.5}Al_{0.2}C_{2.2}Co_{33.9}B_{0.5}Fe_{balance}$ (Example 14), and $SM_{7.2}Nd0.6DY_{2.2}Zr_{2.7}Mn_{1.1}Nb_{1.1}Co_{26.0}B_{1.7}Fe_{balance}$ (Example 15) respectively. When the coercive force of each thin alloy strip thus obtained was measured using a vibrating test type magnetometer (VSM), the coercive force of each of Examples 12 to 15 was found to be 20 kA/m, 33 kA/m, 29 kA/m and 22 kA/m, respectively.

Then, each of thin alloy strips was heat-treated in an inert atmosphere (Ar: 0.9 atm.) at a temperature of 700° C. for 30 minutes. These thin alloy strips were pulverized with a ball mill into particles having an average particle diameter of 20 μm or so and then each alloy powder of Examples 12, 13 and 14 was heat-treated (nitriding treatment) in a nitrogen gas atmosphere of 1 atm. at a temperature of 450° C. for 50 hours to manufacture three kinds of magnetic material powder, each having a composition shown in the following Table 2. On the other hand, the alloy powder of Example 15 was heat-treated in a gas atmosphere comprising 0.02 atm. of ammonia gas and 1 atm. of nitrogen gas at a temperature of 350° C. for 10 hours to manufacture a magnetic material powder having a composition shown in Table 2.

Each of magnetic material powder samples was examined by way of an X-ray diffraction to confirm that the principal phase of every magnetic material powder samples was constituted by the $TbCu_7$ phase. Further, it was found out as a result of the X-ray diffraction that the ratio of lattice constants (c/a) was in the range of from 0.854 to 0.876.

The magnetic properties (the residual magnetic flux density and the maximum energy product) of each magnetic material powder were examined using a vibrating test type magnetometer (VSM). These magnetic properties were calculated assuming the density of the magnetic material powder as being 7.74 g/cm$^3$ and performing a compensation with the demagnetizing factor being set to 0.15, the results being shown in Table 2.

TABLE 2

| | Composition (bal. = balance) | Coercive force immediately after quenching (kA/m) | Residual flux density (T) | Maximum energy product (kJ/m$^3$) |
|---|---|---|---|---|
| Example 11-1 | $Sm_{6.7}Zr_{2.2}Co_{27}B_{1.7}N_{9.4}Fe_{bal.}$ | 12 | 1.05 | 142 |
| Example 11-2 | " | 36 | 1.02 | 134 |
| Example 11-3 | " | 68 | 0.96 | 111 |
| Example 12 | $Sm_{7.2}Zr_{2.0}Ni_{3.0}Ga_{1.0}Co_{20}B_{1.0}$-$N_{9.3}Fe_{bal.}$ | 20 | 1.07 | 144 |
| Example 13 | $Sm_{6.0}Nd_{1.0}Zr_{2.4}Mo_{2.0}Cr_{1.0}Si_{1.0}$-$Co_{23}B_{1.5}N_{8.0}Fe_{bal.}$ | 33 | 1.03 | 134 |
| Example 14 | $Sm_{6.8}Pr_{1.0}Zr_{1.5}Hf_{0.5}W_{0.5}Al_{0.2}$-$Co_{31}B_{0.5}C_{2.0}N_{8.5}Fe_{bal.}$ | 29 | 1.04 | 137 |
| Example 15 | $Sm_{6.5}Nd_{1.0}Dy_{0.5}Zr_{2.3}Mn_{1.0}Nb_{0.5}$-$Co_{23}B_{0.5}H_{1.0}N_{8.5}Fe_{bal.}$ | 22 | 1.05 | 142 |

As apparent from Table 2, any of the magnetic material powder of Examples 11-1 and 11-2 which were obtained through a nitriding treatment using the thin alloy strip not more than 56 kA/m in coercive force (12 kA/m and 36 kA/m) as measured immediately after the quenching were higher in the maximum energy product as compared with the magnetic material powder of Examples 11-3 which was obtained through a nitriding treatment using a thin alloy strip having a coercive force exceeding over 56 kA/m (i.e. a thin alloy strip having a coercive force of 68 kA/m) as measured immediately after the quenching.

Furthermore, any of the magnetic material powder of Examples 12 to 15 which were obtained through a nitriding treatment using the thin alloy strip not more than 56 kA/m in coercive force as measured immediately after the quenching were excellent in magnetic properties.

In the manufacture of the thin alloy strip of Examples 11-1 to 11-3, the ratio of the samples exhibiting a coercive force exceeding over 56 kA/m was slightly less than 30%. However, when the rotation speed (peripheral speed) of the copper roll for receiving the ejection of the hot melt was changed to 42 m/s, the ratio of the samples exhibiting a coercive force exceeding over 56 kA/m could be controlled to less than 5%, so that it was possible to obtain a magnetic material powder having the same properties as those of Examples 11-1 and 11-2 by merely subjecting the thin alloy strips thus obtained to the aforementioned heat treatment, pulverizing treatment and nitriding treatment without discriminating the samples of the thin alloy strips.

(EXAMPLES 16-1 and 16-2)

First of all, an ingot was prepared using as raw materials Sm, Zr, Co and Fe of high purity, and subjecting the raw materials to an arc melting in an Ar atmosphere. The composition of the resultant ingot was composed of 7.5 at. % of Sm, 2.5 at. % of Zr, 27.0 at. % of Co and the balance of Fe. This ingot was then charged together with a prescribed amount of boron (B) in a quartz nozzle and allowed to melt by way of high frequency induction heating in an argon atmosphere. The resultant hot melt was then ejected over a single copper roll having a diameter of 300mm and rotating at a peripheral speed of 40 m/s to manufacture a thin alloy strip. The temperature of the hot melt at the moment of ejection was set to 1350° C. The thickness of a plurality of the resultant thin alloy strips were measured using a calipers, finding that the alloy strips obtained had a thickness in the range of from 5 to 45 μm.

Then, two kinds of thin alloy strips, i.e. one having a thickness of not more than 30 μm, and the other having a thickness of more than 30 μm were selected. These thin alloy strips were then heat-treated in an inert atmosphere (Ar: 0.9 atm.) at a temperature of 700° C. for 30 minutes. These thin alloy strips were then pulverized with a ball mill into particles having an average particle diameter of 20 μm or so and thereafter heat-treated (nitriding treatment) in a nitrogen gas atmosphere of 1 atm. at a temperature of 430° C. for 100 hours to manufacture two kinds of magnetic material powder, each having a composition shown in the following Table 3.

These two kinds of magnetic material powder samples were examined by way of an X-ray diffraction to confirm that the principal phase of every magnetic material powder samples was constituted by the $TbCu_7$ phase. Further, it was found out as a result of the X-ray diffraction that the ratio of lattice constants (c/a) was in the range of from 0.854 to 0.876.

Then, the magnetic properties (the residual magnetic flux density and the maximum energy product) of each of the magnetic material powder were examined using a vibrating test type magnetometer (VSM). These magnetic properties were calculated assuming the density of the magnetic material powder as being 7.74 g/cm$^3$ and performing a compensation with the demagnetizing factor being set to 0.15, the results being shown in Table 3.

(EXAMPLES 17 to 20)

First of all, four kinds of ingots were prepared using as raw materials Sm, Nb, Pr, Dy, Zr, Hf, Mn, Ni, Cr, Al, Ga, Mo, W, Si, Nb, Co and Fe of high purity, subjecting the raw materials to an arc melting in an Ar atmosphere, and then pouring each melt into a mold. Each of these ingots was then charged together with a predetermined amount of boron (B) in a quartz nozzle and allowed to melt by way of high frequency induction heating in an argon atmosphere. Each of these hot melts thus obtained was then ejected over a single copper roll having a diameter of 300 mm and rotating at a peripheral speed of 40 m/s to manufacture four kinds of thin alloy strips. The temperature of the hot melt at the moment of ejection was set to 1340° C. When the compositions of the resultant thin alloy strips were analyzed by way of ICP, it was found that each of the alloy strips contained 1.1 at. %, 1.6 at. %, 0.5 at. %, 1.7 at. % of boron respectively and had the compositions of $SM_{7.9}Zr_{2.2}Ni_{3.3}Ga_{1.1}Co_{22.0}B_{1.1}Fe_{balance}$ (Example 17), $SM_{6.5}Nd_{1.1}Zr_{2.6}Mo_{2.2}Cr_{1.1}Si_{1.1}Co_{25.0}B_{1.6}Fe_{balance}$ (Example 18), $SM_{7.4}Pr_{1.1}Zr_{1.6}Hf_{0.5}W_{0.5}A_{10.2}Co_{33.9}B_{0.5}C_{2.2}Fe_{balance}$ (Example 19), and $SM_{7.2}Nd_{0.6}DY_{2.2}Zr_{2.7}Mn_{1.1}Nb_{1.1}Co_{26.0}B_{1.7}Fe_{balance}$ (Example 20) respectively. The thickness of each of the resultant thin alloy strips was measured using a calipers, finding that the alloy strips obtained had a thickness as shown in the following Table 3.

Then, each of thin alloy strips was heat-treated in an inert atmosphere (Ar: 0.9 atm.) at a temperature of 700° C. for 30 minutes. These thin alloy strips were then pulverized with a ball mill into particles having an average particle diameter of 20 μm or so and then each alloy powder of Examples 17, 18 and 19 was heat-treated (nitriding treatment) in a nitrogen gas atmosphere of 1 atm. at a temperature of 450° C. for 100 hours to manufacture three kinds of magnetic material powder, each having a composition shown in the following Table 3. On the other hand, the alloy powder of Example 20 was heat-treated in a gas atmosphere comprising 0.02 atm. of ammonia gas and 1 atm. of nitrogen gas at a temperature of 350° C. for 10 hours to manufacture a magnetic material powder having a composition shown in Table 3.

Each of magnetic material powder samples was examined by way of an X-ray diffraction to confirm that the principal phase of every magnetic material powder samples were constituted by the $TbCu_7$ phase. Further, it was found out as a result of the X-ray diffraction that the ratio of lattice constants (c/a) was in the range of from 0.854 to 0.876.

The magnetic properties (the residual magnetic flux density and the maximum energy product) of each magnetic material powder were examined using a vibrating test type magnetometer (VSM). These magnetic properties were calculated assuming the density of the magnetic material powder as being 7.74 g/cm$^3$ and performing a compensation with the demagnetizing factor being set to 0.15, the results being shown in Table 3 below.

TABLE 3

| | Composition (bal. = balance) | Thickness of thin strip immediately after quenching (kA/m) | Residual flux density (T) | Maximum energy product (kJ/m³) |
|---|---|---|---|---|
| Example 16-1 | $Sm_{6.7}Zr_{2.2}Co_{27}B_{1.7}N_{9.4}Fe_{bal.}$ | 15–20 | 1.06 | 140 |
| Example 16-2 | " | 32–36 | 0.98 | 114 |
| Example 17 | $Sm_{7.2}Zr_{2.0}Ni_{3.0}Ga_{1.0}Co_{20}B_{1.0}N_{9.3}Fe_{bal.}$ | 15–20 | 1.07 | 143 |
| Example 18 | $Sm_{6.0}Nd_{1.0}Zr_{2.4}Mo_{2.0}Cr_{1.0}Si_{1.0}Co_{23}B_{1.5}N_{8.0}Fe_{bal.}$ | 15–25 | 1.06 | 137 |
| Example 19 | $Sm_{6.8}Pr_{1.0}Zr_{1.5}Hf_{0.5}W_{0.5}Al_{0.2}Co_{31}B_{0.5}C_{2.0}N_{8.5}Fe_{bal.}$ | 15–25 | 1.04 | 137 |
| Example 20 | $Sm_{6.5}Nd_{1.0}Dy_{0.5}Zr_{2.3}Mn_{1.0}Nb_{0.5}Co_{23}B_{0.5}H_{1.0}N_{8.5}Fe_{bal.}$ | 15–25 | 1.07 | 143 |

As apparent from Table 3, the magnetic material powder of Example 16-1 which was obtained through a nitriding treatment using the thin alloy strip having a thickness of 30 μm or less (15 to 20 μm) as measured immediately after the quenching was higher in the maximum energy product as compared with the magnetic material powder of Example 16-2 which was obtained through a nitriding treatment using a thin alloy strip having a thickness of more than 30 μm (32 to 36 μm) as measured immediately after the quenching.

Furthermore, any of the magnetic material powder of Examples 17 to 20 which were obtained through a nitriding treatment using the thin alloy strip having a thickness of 30 μm or less as measured immediately after the quenching were excellent in magnetic properties.

(EXAMPLES 21 to 30)

First of all, an ingot was prepared using as raw materials Sm, Zr, Co, B and Fe of high purity, and subjecting the raw materials to an arc melting in an Ar atmosphere. The composition of the resultant ingot was composed of 7.7 at. % of Sm, 2.5 at. % of Zr, 27.0 at. % of Co, 2.2 at. % of B and the balance of Fe. This ingot was then charged in a quartz nozzle and allowed to melt by way of high frequency induction heating in an argon atmosphere. The resultant hot melt was then ejected over a single copper roll rotating at a peripheral speed of 45 m/s to manufacture a thin alloy strip. The temperature of the hot melt at the moment of ejection was set to 1360° C.

Each of the alloy strips was then vacuum-encapsulated in a quartz tube and heat-treated at a temperature of 700° C. for 20 minutes. Each of the thin alloy strips thus heat-treated was then pulverized in a ball mill into powder having an average particle diameter of 30 μm or less. Further, it was found out as a result of the X-ray diffraction that the lattice constants a and c of the $TbCu_7$ phase could be evaluated as being a=0.486 nm; c=0.419 nm, the ratio of lattice constants c/a being 0.862.

Then, each alloy powder was subjected to a nitriding treatment under the conditions shown in the following Table 4 thereby to obtain ten kinds of magnetic material powder.

Further, the ratio of α-Fe phase in each magnetic material powder was investigated and at the same time the maximum energy product of each magnetic material powder was also investigated by making use of a vibrating test type magnetometer (VSM). Namely, the ratio of α-Fe phase was evaluated by way of the main reflection intensity ratio (I) which can be calculated on the basis of the main reflection intensity ratio ($I_{\alpha\text{-}Fe}$) of the α-Fe phase and the main reflection intensity ratio ($^{I}TbCu_7$) of the $TbCu_7$ which were measured through the X-ray diffraction as illustrated by the following equation.

$$I\ (\%)=[I_{\alpha\text{-}Fe}/(I_{\alpha\text{-}Fe}+{}^{I}TbCu_7)]\times 100$$

The aforementioned maximum energy product was calculated assuming the density of the magnetic material powder as being 7.74 g/cm³ and performing a compensation with the demagnetizing factor being set to 0.15, the results being shown in Table 4.

TABLE 4

| | Nitriding conditions | | | I(%) | Maximum energy product (kJ/m³) |
|---|---|---|---|---|---|
| Example 21 | 20 atm., | 445° C., | 85 hours | 16.0 | 136 |
| Example 22 | 4 atm., | 420° C., | 103 hours | 13.8 | 141 |
| Example 23 | 32 atm., | 468° C., | 35 hours | 15.2 | 134 |
| Example 24 | 14 atm., | 450° C., | 76 hours | 15.0 | 136 |
| Example 25 | 22 atm., | 460° C., | 50 hours | 13.5 | 145 |
| Example 26 | 8 atm., | 425° C., | 122 hours | 14.1 | 140 |
| Example 27 | 3 atm., | 425° C., | 35 hours | 13.0 | 147 |
| | →15 atm., | 445° C., | 70 hours | | |
| Example 28 | 10 atm., | 430° C., | 15 hours | 12.8 | 143 |
| | →22 atm., | 453° C., | 50 hours | | |
| Example 29 | 8 atm., | 465° C., | 85 hours | 23.7 | 108 |
| Example 30 | 35 atm., | 420° C., | 35 hours | 13.0 | 113 |

As apparent from Table 4, any of the magnetic material powder according to Examples 21 to 28, which were obtained through a nitriding treatment under the conditions satisfying the equation of: $2p+400 \leqq T \leqq 2p+420$ (where T represents the nitriding treatment temperature (°C.)) with the nitrogen gas pressure p (atm.) during the nitriding treatment being set to not less than 2 atm. exhibited a higher maximum energy product, thus indicating an improved magnetic properties as compared with any of the magnetic material powder according to Examples 29 and 30 which were obtained through a nitriding treatment which was performed under the conditions falling out of the aforementioned limitations.

(EXAMPLES 31-1 and 31-2)

First of all, an ingot was prepared using as raw materials Sm, Zr, Co, B and Fe of high purity, and subjecting the raw materials to an arc melting in an Ar atmosphere. The composition of the resultant ingot was composed of 7.7 at. % of Sm, 2.5 at. % of Zr, 27.0 at. % of Co, 2.2 at. % of B and the balance of Fe. This ingot was then charged in a quartz nozzle and allowed to melt by way of high frequency induction heating in an argon atmosphere. The resultant hot melt was then ejected over a single copper roll rotating at a peripheral speed of 45 m/s to manufacture a thin alloy strip. The temperature of the hot melt at the moment of ejection was set to 1300° C.

Each of the alloy strips was then vacuum-encapsulated in a quartz tube and heat-treated at a temperature of 700° C. for 20 minutes. Each of the thin alloy strips thus heat-treated was then pulverized in a ball mill into powder and classified thereby to obtain an alloy powder having a particle distribution shown in the following Table 5 (Example 31-1) and an alloy powder having a particle diameter of 20 μm or less (Example 31-2). It was confirmed that the alloy powder according to Example 31-1 contained fine powder having a particle diameter of 2.8 μm or less in a volume ratio of 0.93% as shown in Table 5.

TABLE 5

| Alloy powder | |
|---|---|
| Particle diameter (μm) | Frequency (%) |
| 0.90 | 0.00 |
| 1.40 | 0.00 |
| 1.90 | 0.00 |
| 2.80 | 0.93 |
| 3.90 | 3.09 |
| 5.50 | 7.41 |
| 7.80 | 11.75 |
| 11.00 | 18.15 |
| 16.00 | 22.92 |
| 22.00 | 21.04 |
| 31.00 | 12.00 |
| 44.00 | 2.72 |
| 62.00 | 0.00 |
| 88.00 | 0.00 |
| 125.00 | 0.00 |
| 176.00 | 0.00 |
| 250.00 | 0.00 |
| 350.00 | 0.00 |
| 500.00 | 0.00 |
| 700.00 | 0.00 |

Then, each alloy powder was heat-treated (nitriding treatment) in a nitrogen gas atmosphere of 10 atm. at a temperature of 440° C. for 65 hours to manufacture two kinds of magnetic material powder, each having a composition shown in the following Table 6. Further, it was found out as a result of the X-ray diffraction of the magnetic material powder that all of the diffraction peaks excepting the diffraction peak of α-Fe on the diffraction pattern could be indexed by $TbCu_7$ type crystal structure. Further, it was found out as a result of the X-ray diffraction that the lattice constants a and c of the $TbCu_7$ phase could be evaluated as being a=0.4930 nm; c=0.4252 nm, the ratio of lattice constants c/a being 0.8625. Then, the particle size distribution of each magnetic material powder was measured. As a result, the content of fine powder having a particle diameter of 2.8 μm or less in the magnetic material powder Example of 31-1 was found to be 1.08 vol. %, and the content of fine powder having a particle diameter of 2.8 μm or less in the magnetic material powder Example of 31-2 was found to be 5.35 vol. %.

Then, each magnetic material powder was mixed with 2% by weight of epoxy resin and then compression-molded at a pressure of 8,000 kg/cm$^2$. The resultant molded body was cured at a temperature of 150° C. for 2.5 hours to obtain two kinds of bonded magnets.

The magnetic properties (the residual magnetic flux density, the coercive force and the maximum energy product) at room temperature of the bonded magnets thus obtained were then measured, the results being shown in the following Table 6.

(EXAMPLES 32 to 36)

First of all, five kinds of ingots were prepared using as raw materials Sm, Nb, Pr, Er, Zr, Hf, Ni, V, Ga, Mo, W, Si, B, Co and Fe of high purity, subjecting the raw materials to an arc melting in an Ar atmosphere, and then pouring each melt into a mold. Each of these ingots was then charged in a quartz nozzle and allowed to melt by way of high frequency induction heating in an argon atmosphere. Each of these hot melts thus obtained was then ejected over a single copper roll having a diameter of 300 mm and rotating at a peripheral speed of 45 m/s to manufacture five kinds of thin alloy strips. The temperature of the hot melt at the moment of ejection was set to 1310° C. When the composition of the resultant thin alloy strips were analyzed by way of ICP, it was found that each of the alloy strips was formed of the compositions; $SM_{6.3}Nd_{2.2}Zr_{2.2}Mo_{2.2}Si_{1.1}Co_{22.8}B_{0.9}Fe_{balance}$ (Example 32), $SM_{7.2}Pr_{1.1}Zr_{2.2}V_{2.2}W_{1.1}Ni_{3.2}Co_{17.2}B_{0.9}Fe_{balance}$ (Example 33), $SM_{8.2}Er_{1.1}Zr_{1.1}Hf_{1.1}Mo_{2.2}Ga_{1.1}Co_{20.7}B_{0.9}Fe_{balance}$ (Example 34), $SM_{6.6}Nd_{2.2}Zr_{2.2}Co_{15.2}B_{1.4}C_{1.1}Fe_{balance}$ (Example 35), and $SM_{7.6}Nd_{1.1}Zr_{2.2}Co_{15.1}B_{1.9}Fe_{balance}$ (Example 36), respectively.

Each of the alloy strips was then vacuum-encapsulated in a quartz tube and heat-treated at a temperature of 700° C. for 20 minutes. Each of the thin alloy strips thus heat-treated was then pulverized in a ball mill to obtain an alloy powder.

Then, each alloy powder was heat-treated (nitriding treatment) in a nitrogen gas atmosphere of 10 atm. at a temperature of 440° C. for 65 hours to manufacture five kinds of magnetic material powder, each having a composition shown in the following Table 6. Further, it was found out as a result of the X-ray diffraction of each magnetic material powder that all of the diffraction peaks excepting the diffraction peak of α-Fe on the diffraction pattern could be indexed by $TbCu_7$ type crystal structure. Further, it was found out as a result of the X-ray diffraction that the ratio of lattice constants c/a was in the range of from 0.852 to 0.873. Then, the particle size distribution of each magnetic material powder was measured. As a result, the content of fine powder having a particle diameter of 2.8 μm or less in the magnetic material powder in these Examples 32 to 36 were found to be 1.01 vol. %, 1.23 vol. %, 2.06 vol. %, 0.98 vol. % and 0.92 vol. %, respectively.

Then, each magnetic material powder was mixed with 2% by weight of epoxy resin and then compression-molded at a pressure of 8,000 kg/cm$^2$. The resultant molded body was cured at a temperature of 150° C. for 2.5 hours to obtain five kinds of bonded magnets.

The magnetic properties (the residual magnetic flux density, the coercive force and the maximum energy product) at room temperature of the bonded magnets thus obtained were then measured, the results being shown in the following Table 6.

TABLE 6

| | Composition (bal. = balance) | Content of particle 2.8 μm or less in particle diameter (vol %) | Residual flux density (T) | Coercive force (kA/m) | Maximum energy product (kJ/m³) |
|---|---|---|---|---|---|
| Example 31-1 | $Sm_{7.1}Zr_{2.3}Co_{25}B_{2.0}N_{8.0}Fe_{bal.}$ | 1.08 | 0.80 | 550 | 85 |
| Example 31-2 | " | 5.35 | 0.64 | 535 | 55 |
| Example 32 | $Sm_{5.8}Nd_{2.0}Zr_{2.0}Mo_{2.0}Si_{1.0}$-$Co_{21}B_{1.1}N_{8.0}Fe_{bal.}$ | 1.01 | 0.77 | 593 | 82 |
| Example 33 | $Sm_{6.7}Pr_{1.0}Zr_{2.0}V_{2.0}W_{1.0}Ni_{3.0}$-$Co_{16}B_{0.8}N_{7.0}Fe_{bal.}$ | 1.23 | 0.74 | 555 | 80 |
| Example 34 | $Sm_{7.5}Er_{1.0}Zr_{1.0}Hf_{1.0}Mo_{2.0}$-$Ga_{1.0}Co_{19}B_{0.5}N_{8.0}Fe_{bal.}$ | 2.06 | 0.72 | 618 | 77 |
| Example 35 | $Sm_{6.1}Nd_{2.0}Zr_{2.0}Co_{14}B_{1.3}$-$Co_{1.0}N_{8.0}Fe_{bal.}$ | 0.98 | 0.79 | 582 | 78 |
| Example 36 | $Sm_{7.1}Nd_{1.0}Zr_{2.0}Co_{14}B_{1.8}$-$C_{5.0}N_{7.0}Fe_{bal.}$ | 0.92 | 0.81 | 524 | 86 |

As apparent from Table 6, the bonded magnet of Example 31-1 which was obtained by making use of the magnetic material powder containing not more than 5 vol. % of fine powder having a particle diameter of 2.8 μm or less was superior in all of the residual magnetic flux density, the coercive force and the maximum energy product at room temperature as compared with the bonded magnet of Example 31-2 which was obtained by making use of the magnetic material powder containing more than 5 vol. % of fine powder having a particle diameter of 2.8 μm or less.

Furthermore, any of the bonded magnets of Examples 32 to 36 which were obtained by making use of the magnetic material powder containing not more than 5 vol. % of fine powder having a particle diameter of 2.8 μm or less were excellent in all of the residual magnetic flux density, the coercive force and the maximum energy product at room temperature.

(EXAMPLES 37-1 to 37-5)

First of all, an ingot was prepared using as raw materials Sm, Zr, Co and Fe of high purity, and subjecting the raw materials to an arc melting in an Ar atmosphere. The composition of the resultant ingot was composed of 7.5 at. % of Sm, 2.5 at. % of Zr, 27.0 at. % of Co and the balance of Fe. This ingot was then charged together with a prescribed amount of boron (B) in a quartz nozzle and allowed to melt by way of high frequency induction heating in an argon atmosphere. The resultant hot melt was then ejected over a single copper roll having a diameter of 300 mm and rotating at a peripheral speed of 42 m/s to manufacture a thin alloy strip. The temperature of the hot melt at the moment of ejection was set to 1350° C. When the resultant thin alloy strip was analyzed by way of ICP, it was found that the alloy strip contained 2.16 at. % of boron.

Then, the thin alloy strip thus heat-treated was vacuum-encapsulated in a quartz tube and heat-treated at a temperature of 720° C. for 15 minutes. Each of the thin alloy strips thus heat-treated was then pulverized in a mortar to obtain an alloy powder having a particle diameter of not more than 30 μm, which was subsequently heat-treated (nitriding treatment) in a nitrogen gas atmosphere of 10 atm. at a temperature of 450° C. for 80 hours to manufacture a magnetic material powder. The composition of the resultant magnetic material powder was found to be $SM_{6.88}Zr_{2.29}Co_{24.77}B_{1.97}N_{9.00}Fe_{balance}$ When the aforementioned magnetic material powder was examined by way of an X-ray diffraction, it was confirmed that all of the diffraction peaks excepting the minute diffraction peak of α-Fe on the diffraction pattern could be indexed by $TbCu_7$ type crystal structure of hexagonal system, indicating that the main phase of the magnetic material powder was constituted by the $TbCu_7$ phase. Further, it was found out as a result of the X-ray diffraction that the lattice constants a and c of the $TbCu_7$ phase could be evaluated as being a=0.4925 nm; c=0.4258 nm, hence the ratio of lattice constants c/a being 0.8646.

Then, the magnetic material powder of the aforementioned $TbCu_7$ type and $R_2Fe_{14}B$ system magnetic material powder composed of particles having a particle diameter of not less than 50 μm which was obtained through sieving (MQP-B powder: trade name, a product of GM Co.) were mixed together in the ratios as shown in Table 7 to prepare five kinds of magnetic material powder mixture. Then, each magnetic material powder mixture was mixed with 2% by weight of epoxy resin and then compression-molded at a pressure of 8,000 kg/cm². The resultant molded body was cured at a temperature of 150° C. for 2.5 hours to obtain five kinds of bonded magnets.

The magnetic properties (the residual magnetic flux density, the coercive force and the maximum energy product) at room temperature of the bonded magnets thus obtained were then measured, the results being shown in the following Table 7. This Table 7 also shows for reference the bulk density and magnetic properties at room temperature of a bonded magnet (Example 37-6) which was manufactured using only the aforementioned $TbCu_7$ type magnetic material powder and of a bonded magnet (Comparative Example 3) which was manufactured using only the aforementioned $R_2Fe_{14}B$ system magnetic material powder.

TABLE 7

| | Ratio of $TbCu_7$ system magnetic powder (%) | Bulk density of bonded magnet (g/cc) | Residual flux density (T) | Coercive force (kA/m) | Maximum energy product (kJ/m³) |
|---|---|---|---|---|---|
| Comparative Example 3 | 0 | 6.07 | 0.71 | 734 | 81 |
| Example 37-1 | 10 | 6.19 | 0.73 | 722 | 85 |
| Example 37-2 | 30 | 6.25 | 0.75 | 715 | 86 |
| Example 37-3 | 50 | 6.32 | 0.77 | 705 | 88 |
| Example 37-4 | 70 | 6.29 | 0.77 | 692 | 88 |

TABLE 7-continued

| | Ratio of $TbCu_7$ system magnetic powder (%) | Bulk density of bonded magnet (g/cc) | Residual flux density (T) | Coercive force (kA/m) | Maximum energy product ($kJ/m^3$) |
|---|---|---|---|---|---|
| Example 37-5 | 90 | 6.25 | 0.76 | 662 | 86 |
| Example 37-6 | 100 | 6.10 | 0.73 | 625 | 82 |

As apparent from Table 7, the bonded magnets of Examples 37-1 to 37-5 which were manufactured with the co-use of the magnetic material powder of the aforementioned $TbCu_7$ type and magnetic material powder of $R_2Fe_{14}B$ system as illustrated above were superior in packing density and hence in magnetic properties as compared with the bonded magnet of Example 37-6 which was manufactured using only the aforementioned $TbCu_7$ type magnetic material powder.

Meanwhile, the bonded magnet of Comparative Example 3 which was manufactured using only the aforementioned $R_2Fe_{14}B$ system magnetic material powder was poor in corrosion resistance so that the magnetic properties thereof would be easily deteriorated.

By contrast, the bonded magnets of Examples 37-1 to 37-5 which were manufactured with the co-use of the magnetic material powder of the aforementioned $TbCu_7$ type and another magnetic material powder of $R_2Fe_{14}B$ type as illustrated above were excellent in corrosion resistance. For example, when the bonded magnets of Examples 37-1 to 37-5 were subjected to a corrosion test in a thermo-hygrostat under the conditions of 90% in humidity and 80° C. in temperature to see any change in magnetic properties, the bonded magnets containing not less than 50 vol. % of $TbCu_7$ type magnetic material powder exhibited substantially no generation of corrosion, indicating an excellent anti-corrosion. However, as the ratio of the $R_2Fe_{14}B$ system magnetic material powder in the bonded magnet was increased, the generation of rust became more prominent, badly deteriorating the magnetic properties of the bonded magnet.

Table 8 shows the results of the corrosion test which was performed on the bonded magnets of Examples 37-1 to 37-5 as well as on the bonded magnet of Comparative Example 3 described in Table 7.

TABLE 8

| | Generation of rust | Reduction ratio of maximum energy product (%) |
|---|---|---|
| Comparative Example 3 | Rust was entirely observed | 8.2 |
| Example 37-1 | Rust was partially observed | 3.3 |
| Example 37-2 | Rust was slightly observed | 1.2 |
| Example 37-3 | Rust was not observed at all | 0.5 |

As explained above, it is possible according to this invention to provide a magnetic material excellent in residual magnetic flux density. Therefore, with the employment of such an excellent magnetic material, it is possible to manufacture a permanent magnet such as a bonded magnet which is excellent in magnetic properties.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A magnetic material having a composition represented by the formula:

$$R1_xR2_yB_zA_uM_{100-x-y-z-u}$$

wherein R1 is at least one element selected from the group consisting of rare earth elements; R2 is at least one element selected from the group consisting of Zr, Hf and Sc; A is at least one element selected from the group consisting of H, N, C and P; M is at least one element selected from the group consisting of Fe and Co; x, y, z and u are atomic percent individually defined as $2 \leqq x$, $0.1 \leqq y \leqq 10$, $2 \leqq x+y \leqq 20$, $0.001 \leqq z \leqq 10$, and $0 \leqq u \leqq 20$; and a principle phase of said magnetic material having a $TbCu_7$ crystal structure.

2. The magnetic material of claim 1, wherein a ratio of lattice a and c of said $TbCu_7$ crystal structure (c/a) is 0.847 or more.

3. The magnetic material of claim 1, wherein said R1 contains 50 atomic percent or more of Sm, with the balance being Pr, Nd or both.

4. The magnetic material of claim 1, wherein said z in said formula satisfies the equation $0.1 \leqq z \leqq 3$.

5. The magnetic material of claim 1, wherein said M contains 50 atomic percent or more of Fe.

6. The magnetic material of claim 5, wherein said M contains 70 atomic percent or more of Fe.

7. The magnetic material of claim 1, wherein said y in said formula satisfies the equation $1 \leqq Y \leqq 3$.

8. The magnetic material of claim 1, wherein R1 is selected from the group consisting of La, Ce, Pr, Nd, Sm, Eu, Gd, Tb, Dy, Ho, Er, Tm, Lu and Y.

9. A bonded magnet, comprising:

a magnetic material powder having a composition represented by the formula:

$$R1_xR2_yB_zA_uM_{100-x-y-z-u}$$

wherein R1 is at least one element selected from the group consisting of rare earth elements; R2 is at least one element selected from the group consisting of Zr, Hf and Sc; A is at least one element selected from the group consisting of H, N, C and P; M is at least one element selected from the group consisting of Fe and Co; x, y, z and u are atomic percent individually defined as $2 \leqq x$, $0.1 \leqq y \leqq 10$, $2 \leqq x+y \leqq 20$, $0.001 \leqq z \leqq 10$, and $0 \leqq u \leqq 20$; and a principle phase of said magnetic material having a $TbCu_7$ crystal structure;

and a binder.

10. The bonded magnet of claim 9, wherein said binder is a synthetic material.

11. The bonded magnet of claim 9, wherein said magnetic material powder contains not more than 5 vol % of fine powder having a particle diameter of 2.8 μg or less.

12. The bonded magnet of claim 9, which further comprises magnetic material powder having a principle phase of a $R_2Fe_{14}B$ phase, wherein R is at least one element selected from the group consisting of rare earth elements including Y.

13. The bonded magnet of claim 12, wherein a mixing ratio (A/B) by weight between a magnetic material powder (A) having the formula represented by $R1_xR2_yB_zA_uM_{100-x-y-z-u}$ and magnetic material powder (B) having the $R_2Fe_{14}B$ phase as a principle phase is 0.1 to 10.

14. The bonded magnet of claim 9, wherein in said magnetic material a ratio of lattice a and c of said $TbCu_7$ crystal structure (c/a) is 0.847 or more.

15. The bonded magnet of claim 9, wherein said R1 of said magnetic material contains 50 atomic percent or more of Sm, with the balance being Pr, Nd or both.

16. The bonded magnet of claim 9, wherein said z in said formula for said magnetic material satisfies the equation $0.1 \leqq z \leqq 3$.

17. The bonded magnet of claim 9, wherein said M in said formula for said magnetic material contains 50 atomic percent or more of Fe.

18. The bonded magnet of claim 17, wherein said M in said formula contains 70 atomic percent or more of Fe.

19. The bonded magnet of claim 9, wherein said y in said formula satisfies the equation $1 \leqq y \leqq 3$.

20. The bonded magnet of claim 9, wherein R1 is selected from the group consisting of La, Ce, Pr, Nd, Sm, Eu, Gd, Tb, Dy, Ho, Er, Tu, Lu and Y.

* * * * *